US006276059B1

(12) United States Patent
Kan

(10) Patent No.: US 6,276,059 B1
(45) Date of Patent: Aug. 21, 2001

(54) OPENER FOR PACKAGING FILM

(76) Inventor: Elvin Man Kit Kan, Room 1905, 19/F., Tai Sang Commercial Bldg., 24-34 Hennessy Road, Wanchai (HK)

( * ) Notice: Subject to any disclaimer, the term of this patent is extended or adjusted under 35 U.S.C. 154(b) by 0 days.

(21) Appl. No.: 09/542,950

(22) Filed: Apr. 4, 2000

(51) Int. Cl.[7] ..... B26B 1/06
(52) U.S. Cl. ..... 30/2; 30/293
(58) Field of Search ..... 30/2, DIG. 3, 293, 30/294

(56) References Cited

U.S. PATENT DOCUMENTS 2,649,656 * 8/1953 Hedrick ..... 30/DIG. 3
5,617,635 * 4/1997 Berns ..... 30/2 X

* cited by examiner

*Primary Examiner*—Douglas D. Watts
(74) *Attorney, Agent, or Firm*—Rabin & Champagne, P.C.

(57) ABSTRACT

An opener (100) for cutting open a packaging film of a box containing a CD, CD-ROM, VCD or DVD disc or the like, which opener (100) has a body (10) providing a gap (18) for receiving a part of a narrow side of the box. Inside the body (10), the opener (100) includes a cutter (29) and an operating member (20) for operation to move the cutter (29) into the gap (18) for cutting open the packaging film. The operating member (20) has a knob (24) for operation, which is resiliently biassed by a spring (40) to be accessible in the gap (18).

10 Claims, 3 Drawing Sheets

OPENER FOR PACKAGING FILM

The present invention relates to an opener for cutting open a packaging film of a CD, CD-ROM, VCD or DVD box or the like.

BACKGROUND OF THE INVENTION

A CD, CD-ROM, VCD or DVD disc is normally sold in a thin plastic box which is, in turn, usually wrapped by a packaging film. Experience tells that the tearing open of the packaging film may not be easy for a customer using bare hands, and a knife is sometimes needed.

The invention seeks to mitigate or to at least alleviate such a problem by providing an opener.

SUMMARY OF THE INVENTION

According to the invention, there is provided an opener for cutting open a packaging film of a box containing a CD, CD-ROM, VCD or DVD disc or the like, which opener comprises a body having a gap for receiving a part of a narrow side of a said box, a cutter provided in the body, and an operating member provided in the body for operation to move the cutter into the gap for cutting open the packaging film of said box with a narrow side thereof inserted into the gap, said operating member being associated with an actuator for operation, which is resiliently biased to be accessible in the gap.

Preferably, the operating member is supported for pivotal movement between a rest position in which the actuator is accessible in the gap and an operating position in which the cutter extends into the gap.

More preferably, a spring is provided in the body for resiliently biassing the operating member into the rest position.

For simple construction, the actuator is an integral part of the operating member.

For simple construction, the cutter is supported on the operating member.

It is preferred that the gap has a bottom side and the body is formed with two apertures at the bottom side of the gap, through which apertures the actuator and cutter are extendable into the gap.

In a preferred embodiment, the body is formed by two generally flat parts stacked together, each said body part having a principal wall and a continuous side wall including respective straight sections aligned with each other to form a bottom side of the gap.

More preferably, the body has a generally flat cylindrical shape.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
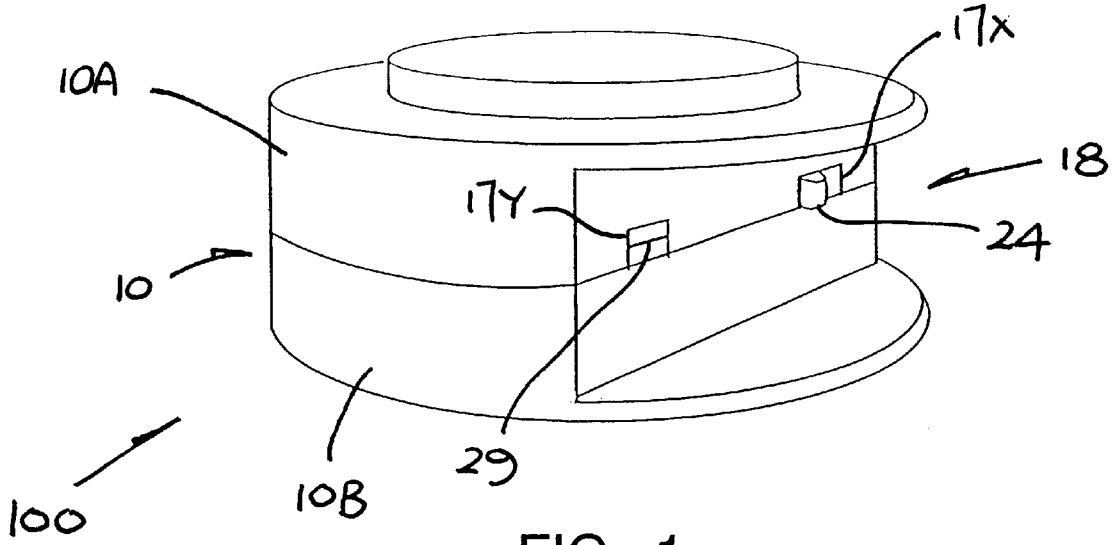
FIG. 1 is a top perspective view of an embodiment of an opener in accordance with the invention.
Figure 2:
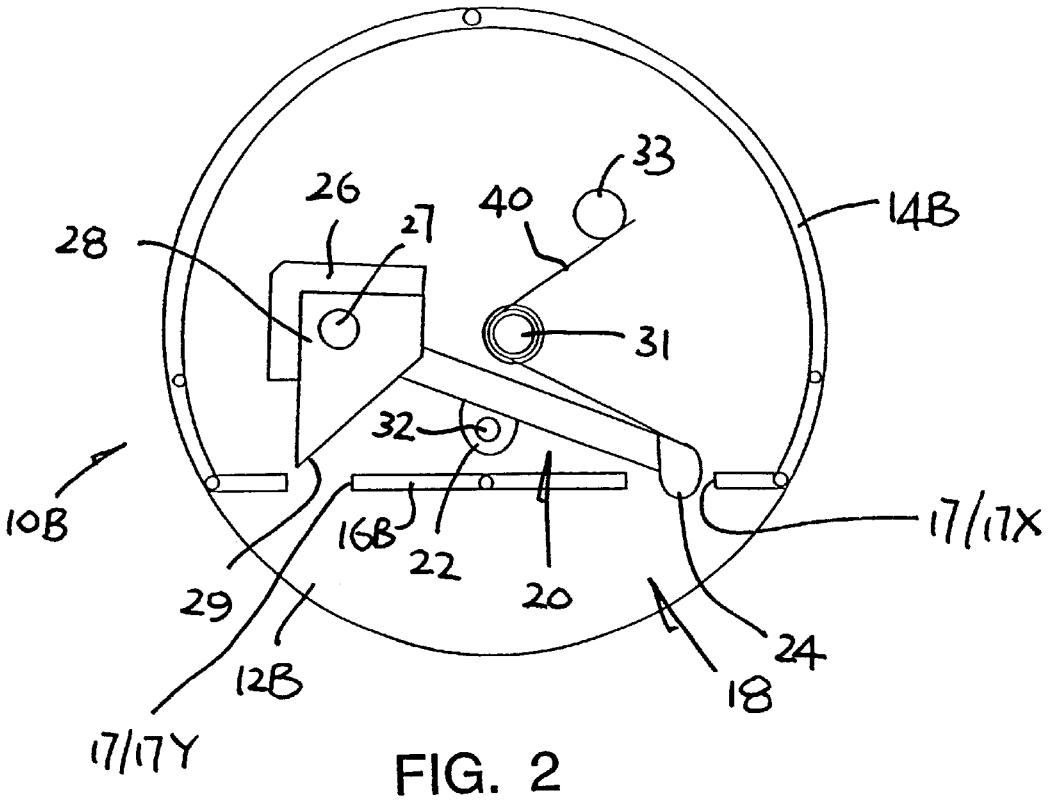
FIG. 2 is a top plan view showing the internal construction of the opener of FIG. 1.
Figure 3:
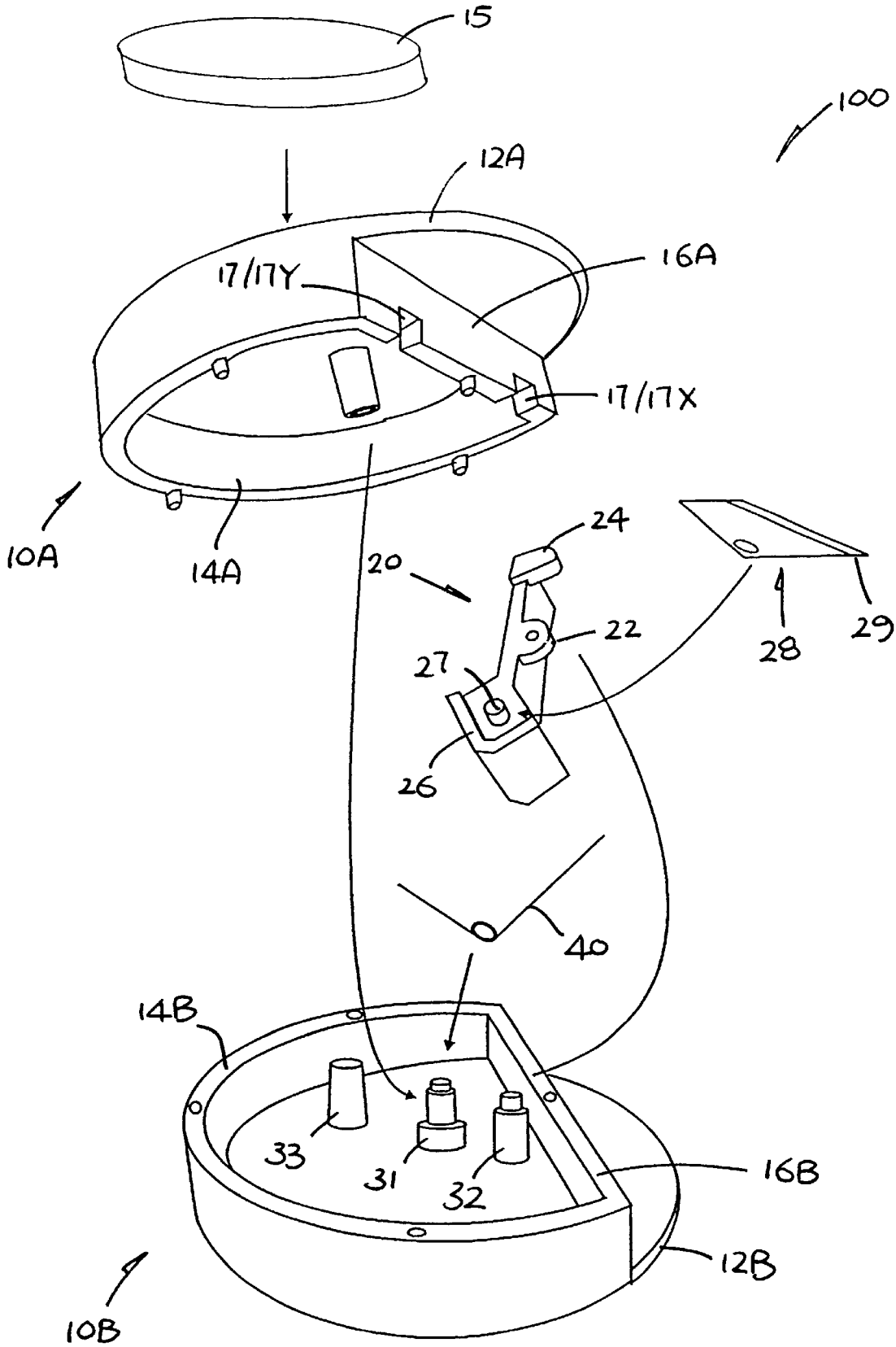
FIG. 3 is an exploded perspective view of the opener of FIGS. 1 and 2.
Figure 4:
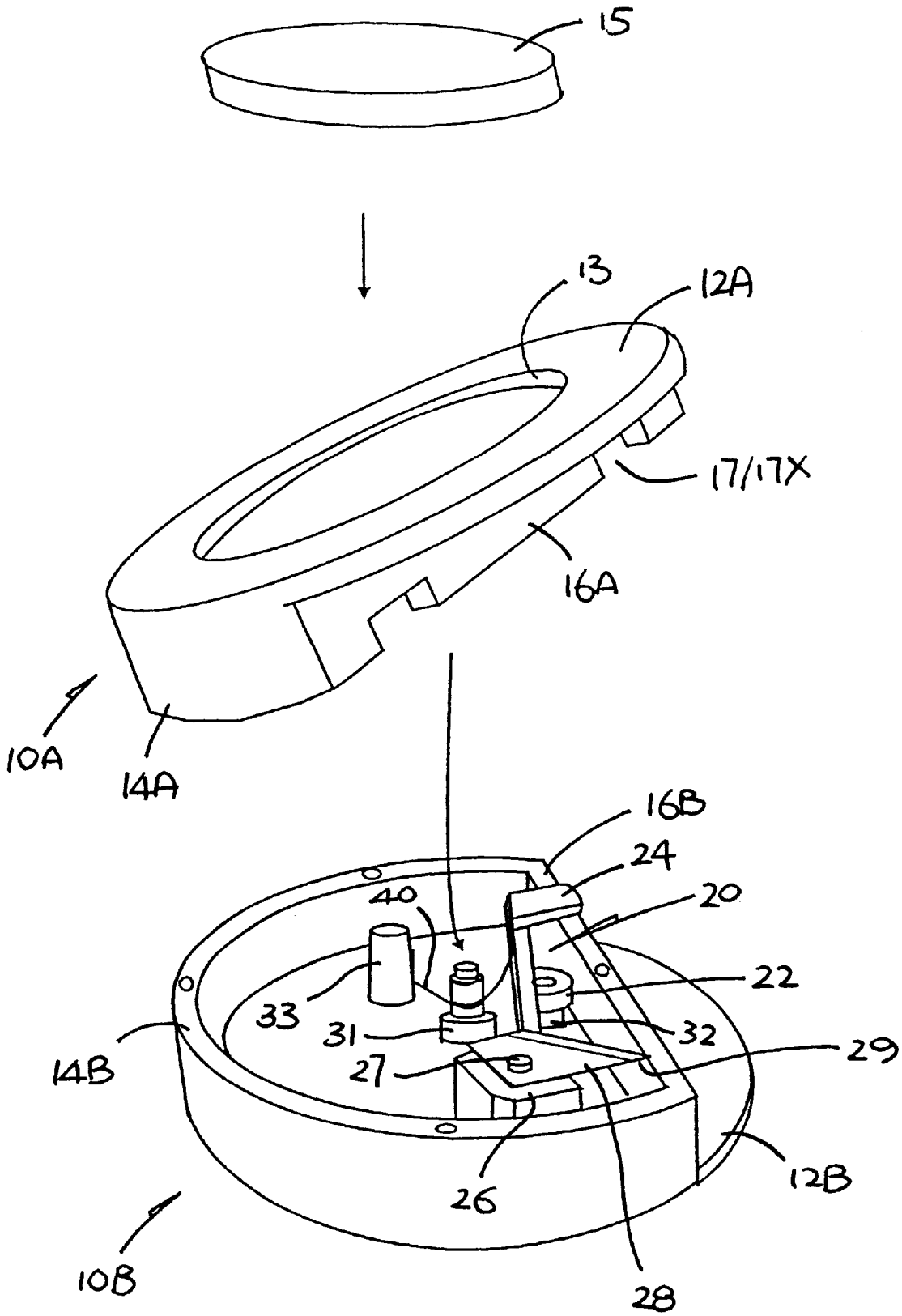
FIG. 4 is a semi-exploded perspective view corresponding to FIG. 3.

Referring to the drawings, there is shown an opener 100 embodying the invention for cutting open a packaging film of a thin plastic box containing a CD, CD-ROM, VCD, DVD disc or the like, which opener 100 has a plastic body 10 formed by two generally flat cylindrical parts 10A and 10B stacked or connected co-axially together. Each body part 10A/10B has a circular principal or base wall 12A/12B and a continuous integral side wall 14A/14B, of which a section 16A/16B is made straight to expose a part of the base wall 12A/12B. The two wall sections 16A and 16B are aligned with each other, thereby forming a gap 18 between the exposed parts of the base walls 12A and 12B, with the sections 16A and 16B together forming a bottom side of the gap 18. The gap 18 has a width slightly larger than the thickness of a CD box or the like.

The wall section 16A of one body part 10A is formed with two notches 17 at opposite ends, which form a pair of apertures 17X and 17Y in the aligned sections 16A and 16B or the bottom side of the gap 18. Upstanding from the base wall 12B of the other body part 10B, a center post 31 and two side posts 32 and 33 are formed. The first side post 32 is located adjacent to the wall section 16B, and the second side post 33 is located on the opposite side of the centre post 31.

The opener 100 includes a elongate operating member 20 provided inside the body 10 for operation. The operating member 20 has an apertured middle part 22 hinged about the first side post 32, an actuating knob 24 integrally formed at one end, and a seat 26 provided at the other end. The three parts 22, 24 and 26 protrude laterally from the body of the operating member 20 and face the wall sections 16A and 16B from inside. The seat 26 is formed with a short post 27 for locating a short cutting blade 28 having a sharp corner 29. The arrangement is such that the knob 24 and cutting corner 29 are aligned with and alternatively extendable out through respective apertures 17X and 17Y.

The operating member 20 is supported for pivotal movement between a rest position in which the knob 24 extends out through its associated aperture 17X and an operating position in which the cutting corner 29 extends out through its associated aperture 17Y. An elbow spring 40 is located about the second side post 33 for resiliently biassing the operating member 20 into the rest position, such that the knob 24 is accessible in the gap 18 and the cutting corner 29 is hidden wholly within the body 10.

In order to cut open the packaging film of a CD box or the like, the opener 100 is initially placed upon, to ride on, one narrow side of the CD box, with its gap 18 receiving part of the CD box side. Alternatively, the CD box is inserted with one of its narrow sides into the gap 18. Pressing of the opener 100 and the CD box together will push the knob 24 into the respective aperture 17X, which results in the cutting comer 29 being levered slightly out through the other aperture 17Y for cutting the packaging film. Upon sliding of the opener 100 along the CD box side or vice versa, while the pressing force is being maintained, the cutting comer 29 will slice the packaging film open.

The body part 10A is formed with a circular recess 13 for locating a disc 15. The disc 15 may be magnetic for attaching the overall opener 100 onto an iron surface or carry a label for promotional or advertising purposes.

The subject invention provides an opener which is easy and safe to use, in that the cutter 29 is normally (when not in use) hidden wholly within the bottom side of the gap 18 and the gap 18 is also useful to guide the movement of the opener 100.

The invention has been given by way of example only, and various modifications of and/or alterations to the described embodiment may be made by persons skilled in the art without departing from the scope of the invention as specified in the appended claims.

What is claimed is:

1. An opener for cutting open a packaging film of a box, comprising:

a body having a gap for receiving an edge of the box, said body having two apertures at a bottom of the gap;

an operating member disposed in said body, said operating member having an actuator being resiliently biased to extend through one of the apertures and into the gap; and a cutter provided in said body, and being extendable through the other one of the apertures and into the gap;

wherein when the edge of the box is inserted into the gap, the edge urges the actuator out of the gap, thereby causing said operating member to move said cutter into the gap for cutting open the packaging film.

2. The opener as claimed in claim 1, wherein the operating member is supported for pivotal movement between a rest position in which the actuator is accessible in the gap and an operating position in which the cutter extends into the gap.

3. The opener as claimed in claim 2, wherein a spring is provided in the body for resiliently biassing the operating member into the rest position.

4. The opener as claimed in claim 1, wherein the actuator is an integral part of the operating member.

5. The opener as claimed in claim 1, wherein the cutter is supported on the operating member.

6. The opener as claimed in claim 1, wherein the body is formed by two generally flat parts stacked together, each body part having a principal wall and a continuous side wall including respective straight sections aligned with each other to form the bottom side of the gap.

7. The opener as claimed in claim 6, wherein the body has a generally flat cylindrical shape.

8. The opener as claimed in claim 1, wherein the box contains a CD, CD-ROM, VCD, or DVD disc.

9. An opener for cutting open a packaging film of a box, comprising:

a body having a generally flay, cylindrical shape, and having a gap for receiving an edge of the box, said body further including two generally flat body parts stacked together, each body part having a principal wall and a continuous side wall, each side wall having a continuous straight section, the respective straight sections being aligned with each other to form a bottom side of the gap;

an operating member disposed in said body, said operating member having an actuator being resiliently biased to extend into the gap; and a cutter provided in said body, and being extendable into the gap;

wherein when the edge of the box is inserted into the gap, the edge urges the actuator out of the gap, thereby causing said operating member to move said cutter into the gap for cutting open the packaging film.

10. The opener as claimed in claim 9, wherein the box contains a CD, CD-ROM, VCD, or DVD disc.

* * * * *